United States Patent [19]

Kaneko et al.

[11] 4,345,670

[45] Aug. 24, 1982

[54] ELEVATOR CONTROL SYSTEM

[75] Inventors: Takashi Kaneko; Tatsuo Iwasaka, both of Katsuta, Japan

[73] Assignee: Hitachi, Ltd., Tokyo, Japan

[21] Appl. No.: 222,767

[22] Filed: Jan. 6, 1981

[30] Foreign Application Priority Data

Jan. 7, 1980 [JP] Japan ..... 55-125

[51] Int. Cl.[3] ..... B66B 5/02

[52] U.S. Cl. ..... 187/29 R; 371/11

[58] Field of Search ..... 189/29; 371/11, 14, 371/25

[56] References Cited

U.S. PATENT DOCUMENTS 4,047,596 9/1977 Winkler ..... 187/29

4,162,719 7/1979 Husson et al. ..... 187/29

4,210,226 7/1980 Ichioka ..... 187/29

*Primary Examiner*—J. V. Truhe

*Assistant Examiner*—W. E. Duncanson, Jr.

*Attorney, Agent, or Firm*—Craig and Antonelli

[57] ABSTRACT

An elevator control system comprises a control unit for controlling at least one elevator in accordance with a first group of programs and a second group of programs to impart a plurality of functions to the elevator and a fault detection means for detecting any fault in the functions. The control unit functions to stop the control of the elevator by the control unit when a fault due to a program of the first group which is essential to the operation of the elevator occurs, and when a fault due to a program of the second group occurs, the control units functions to bypass the control by the fault program and continue the operation of the elevator by the other programs.

12 Claims, 22 Drawing Figures

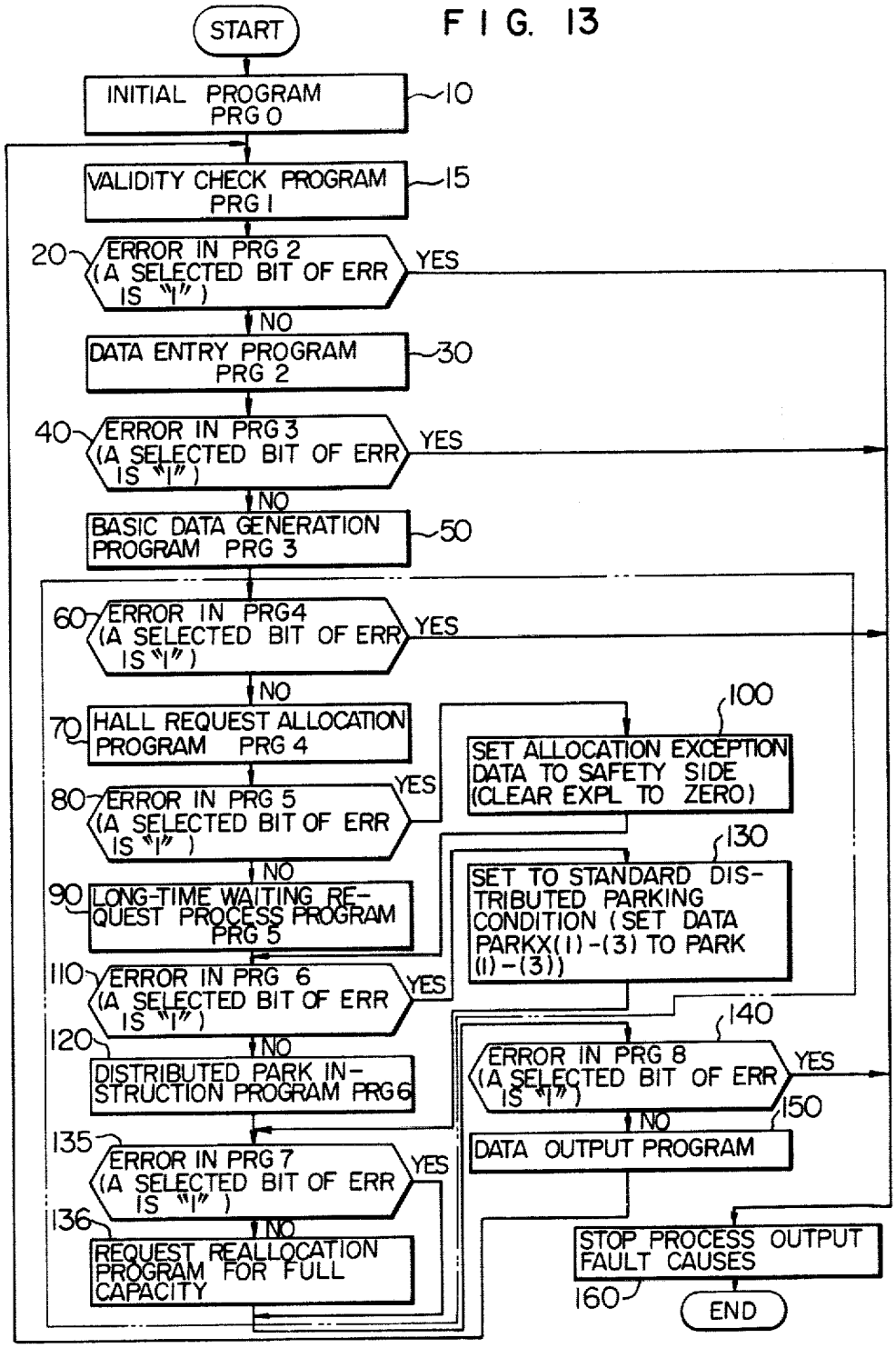
FIG. 13
START
INITIAL PROGRAM PRG 0
10
VALIDITY CHECK PROGRAM PRG 1
15
20
ERROR IN PRG 2 (A SELECTED BIT OF ERR IS "1")
YES
NO
DATA ENTRY PROGRAM PRG 2
30
40
ERROR IN PRG 3 (A SELECTED BIT OF ERR IS "1")
YES
NO
BASIC DATA GENERATION PROGRAM PRG 3
50
60
ERROR IN PRG4 (A SELECTED BIT OF ERR IS "1")
YES
NO
70
HALL REQUEST ALLOCATION PROGRAM PRG 4
80
ERROR IN PRG 5 (A SELECTED BIT OF ERR IS "1")
YES
NO
90
LONG-TIME WAITING REQUEST PROCESS PROGRAM PRG 5
110
ERROR IN PRG 6 (A SELECTED BIT OF ERR IS "1")
YES
NO
120
DISTRIBUTED PARK INSTRUCTION PROGRAM PRG6
135
ERROR IN PRG 7 (A SELECTED BIT OF ERR IS "1")
YES
NO
136
REQUEST REALLOCATION PROGRAM FOR FULL CAPACITY
100
SET ALLOCATION EXCEPTION DATA TO SAFETY SIDE (CLEAR EXPL TO ZERO)
130
SET TO STANDARD DISTRIBUTED PARKING CONDITION (SET DATA PARKX(1)-(3) TO PARK (1)-(3))
140
ERROR IN PRG 8 (A SELECTED BIT OF ERR IS "1")
YES
NO
150
DATA OUTPUT PROGRAM
STOP PROCESS OUTPUT FAULT CAUSES
160
END

ELEVATOR CONTROL SYSTEM

The present invention relates to an elevator control and more particularly to an elevator control system which offers an effective control in case of fault of a control unit including a number of functions.

In recent yearns, as the semiconductor and computer technologies have developed, the elevator control unit has been digitized so that a number of control functions are centrally processed in the control unit. This, on one hand, attains the smaller size and higher performance, and on the other hand provides a risk of disability of elevator service because a fault in one device results in the stop of all functions.

To resolve the above problem, in U.K. Patent Application Laid-Open No. 2000327A, a computerized elevator control system has dual systems of identical function so that when a fault occurs in one of the computers the other computer is activated to continue the operation. This prevents the disability of elevator service.

It is an object of the present invention to provide an elevator control system which can reduce the possibility of unavailability of service in case of system fault without using a complex control unit.

In accordance with the present invention, at least one elevator is controlled by a first group of programs and a second group of programs such that a plurality of functions are imparted to the elevator. When the control function based on the first group of programs, which is essential to the operation of the elevator, is in a fault condition, the elevator control by the control system is stopped, but when a fault based on the second group of programs occurs, the program control in the fault condition is bypassed and the operation of the elevator is continued by the other programs.

The above and other objects and features of the present invention will become more apparent from the following description of the invention when taken in conjunction with the accompanying drawings; in which.

Figure 3:
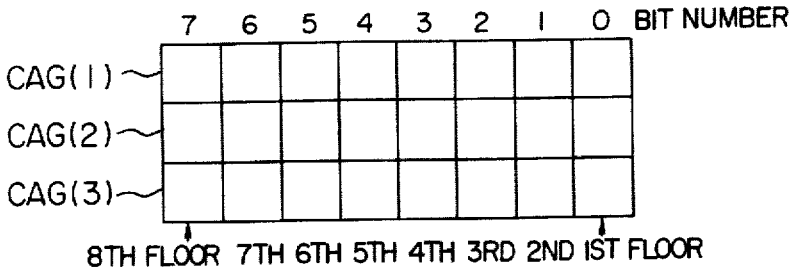
Figure 4:
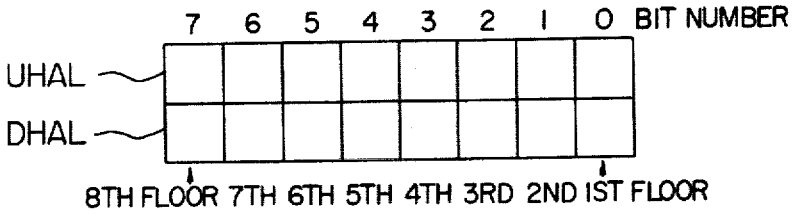
Figure 5:
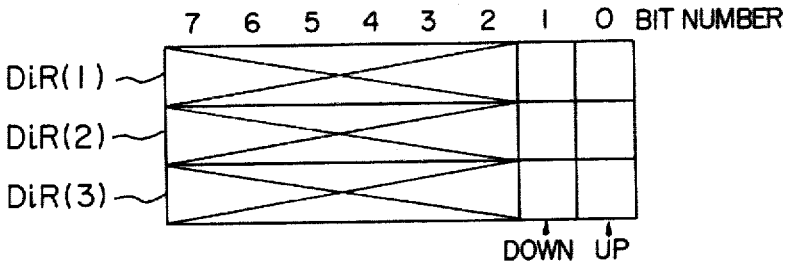
Figure 6:
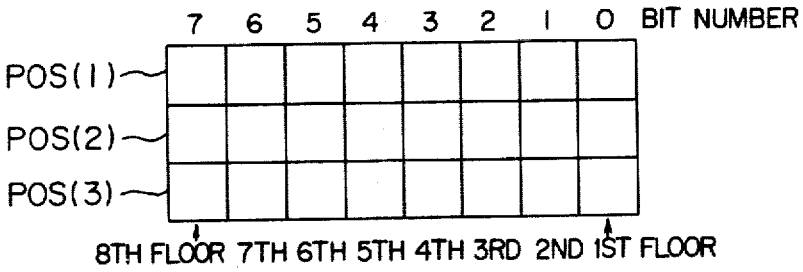
Figure 7:
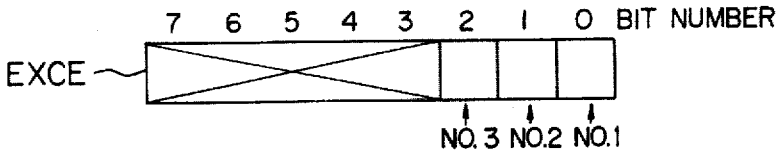
Figure 8:
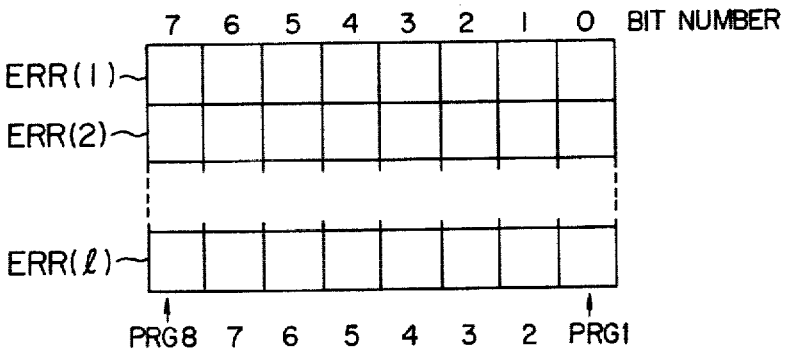
Figure 9:
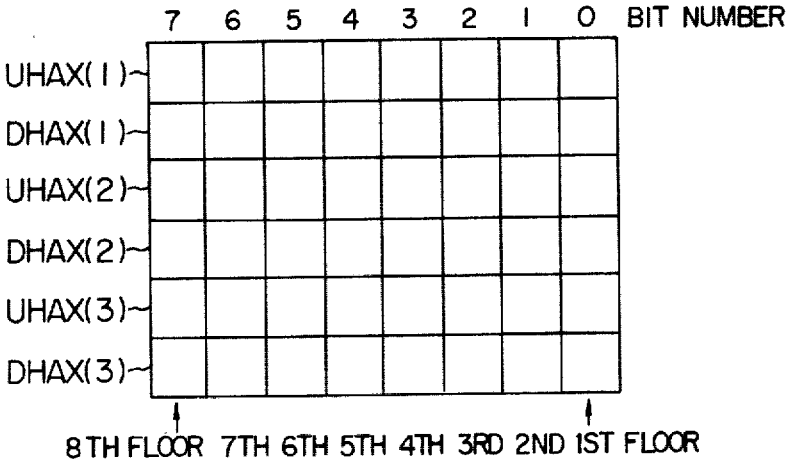
Figure 10:
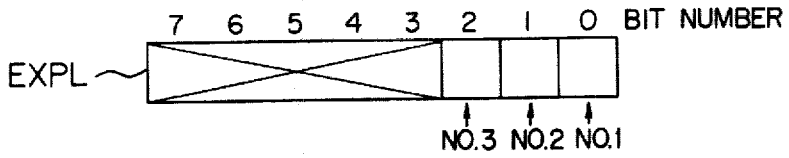
Figure 11:
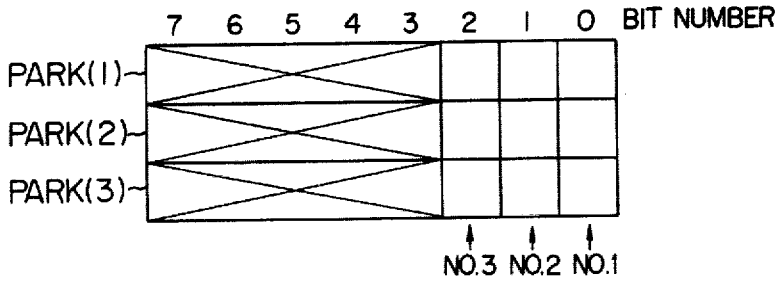
Figure 12:
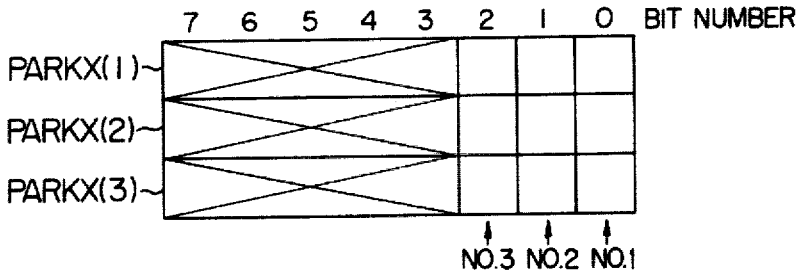
Figure 14:
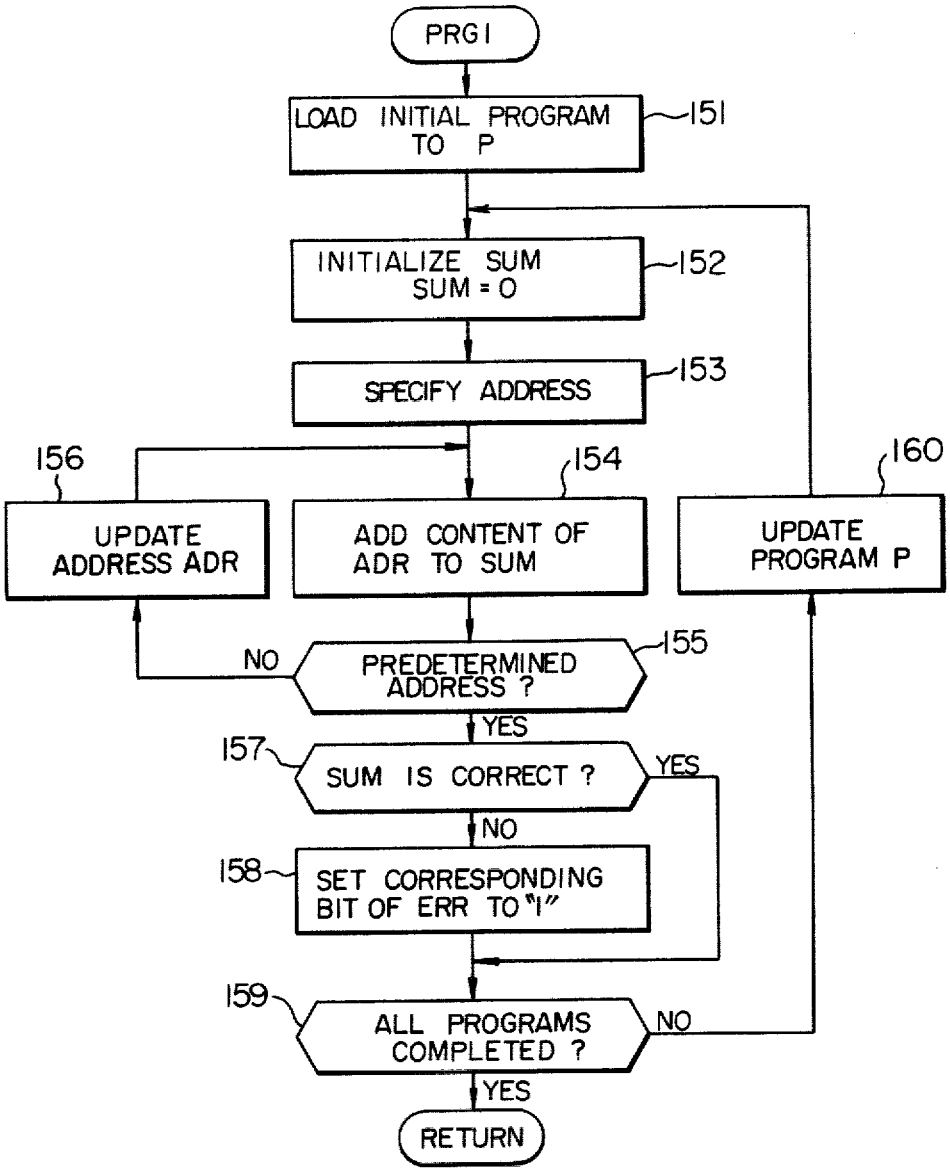
Figure 15:
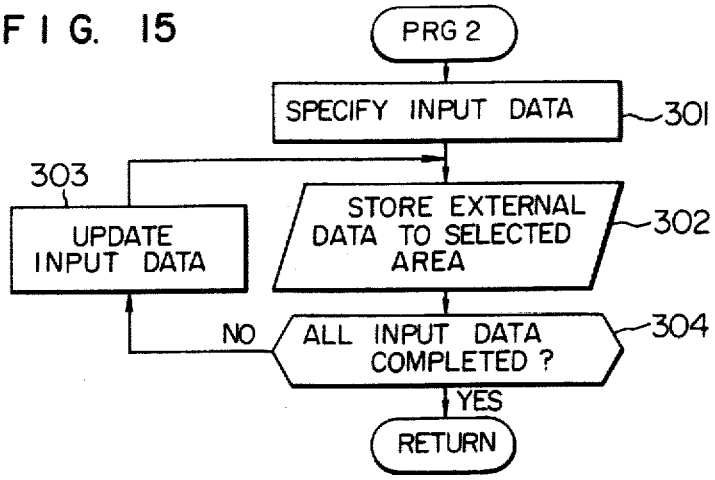
Figure 18:
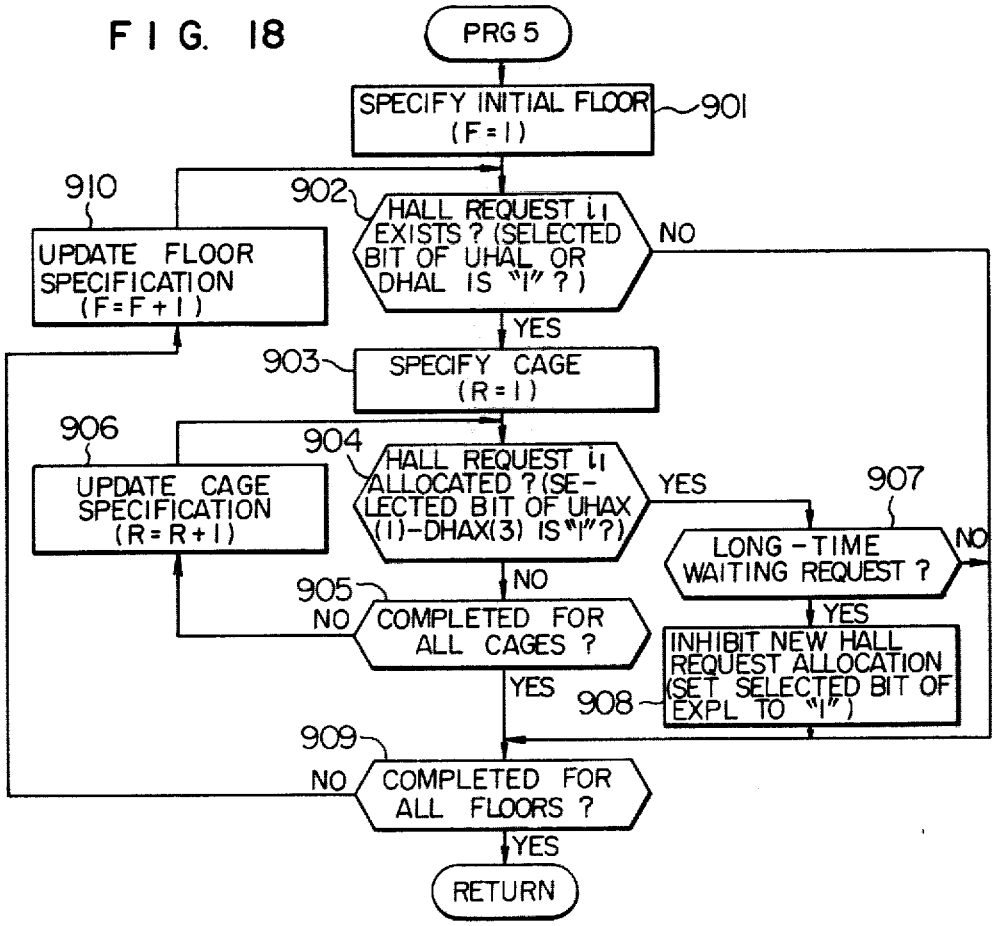
Figure 16:
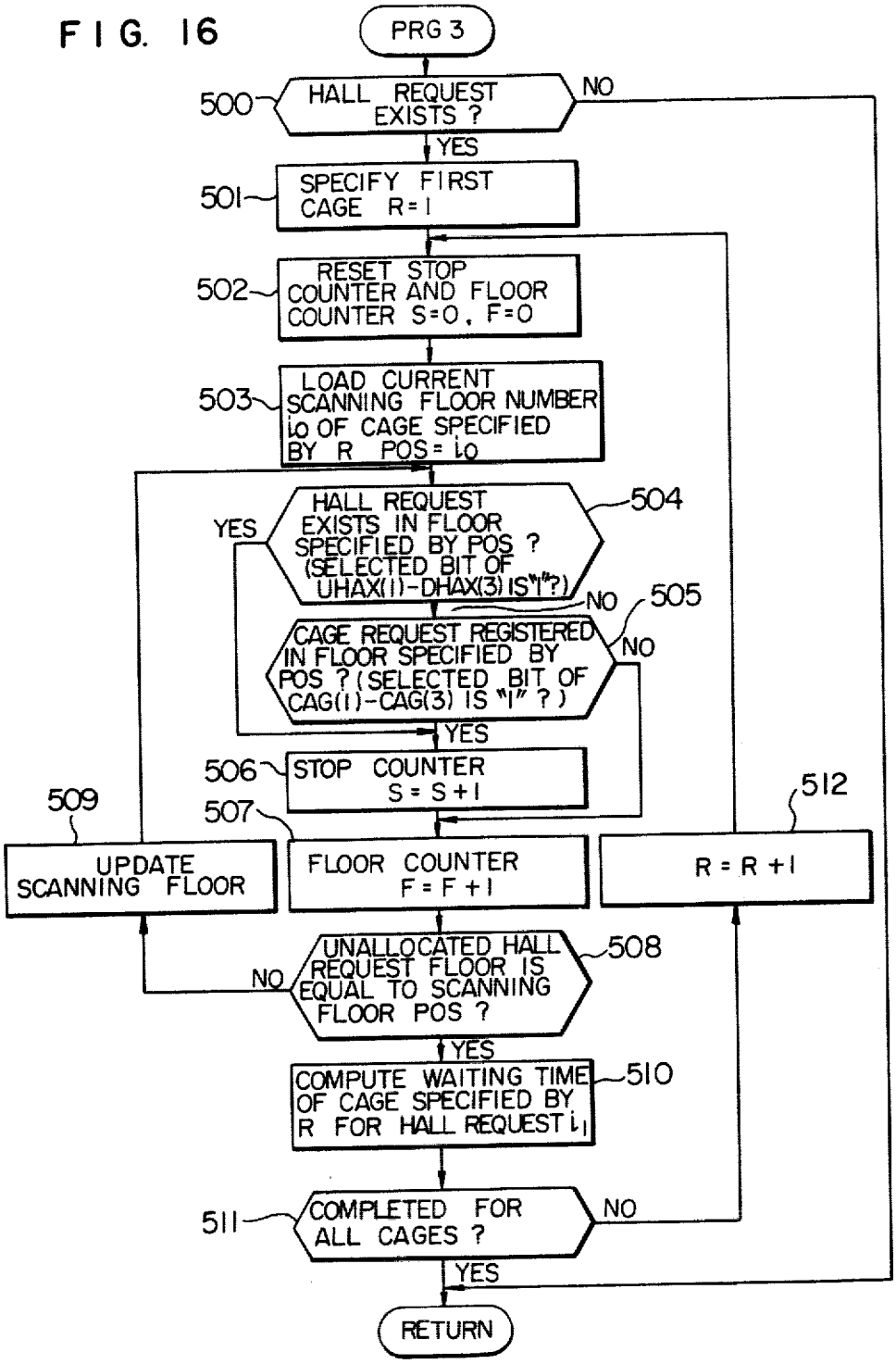
Figure 17:
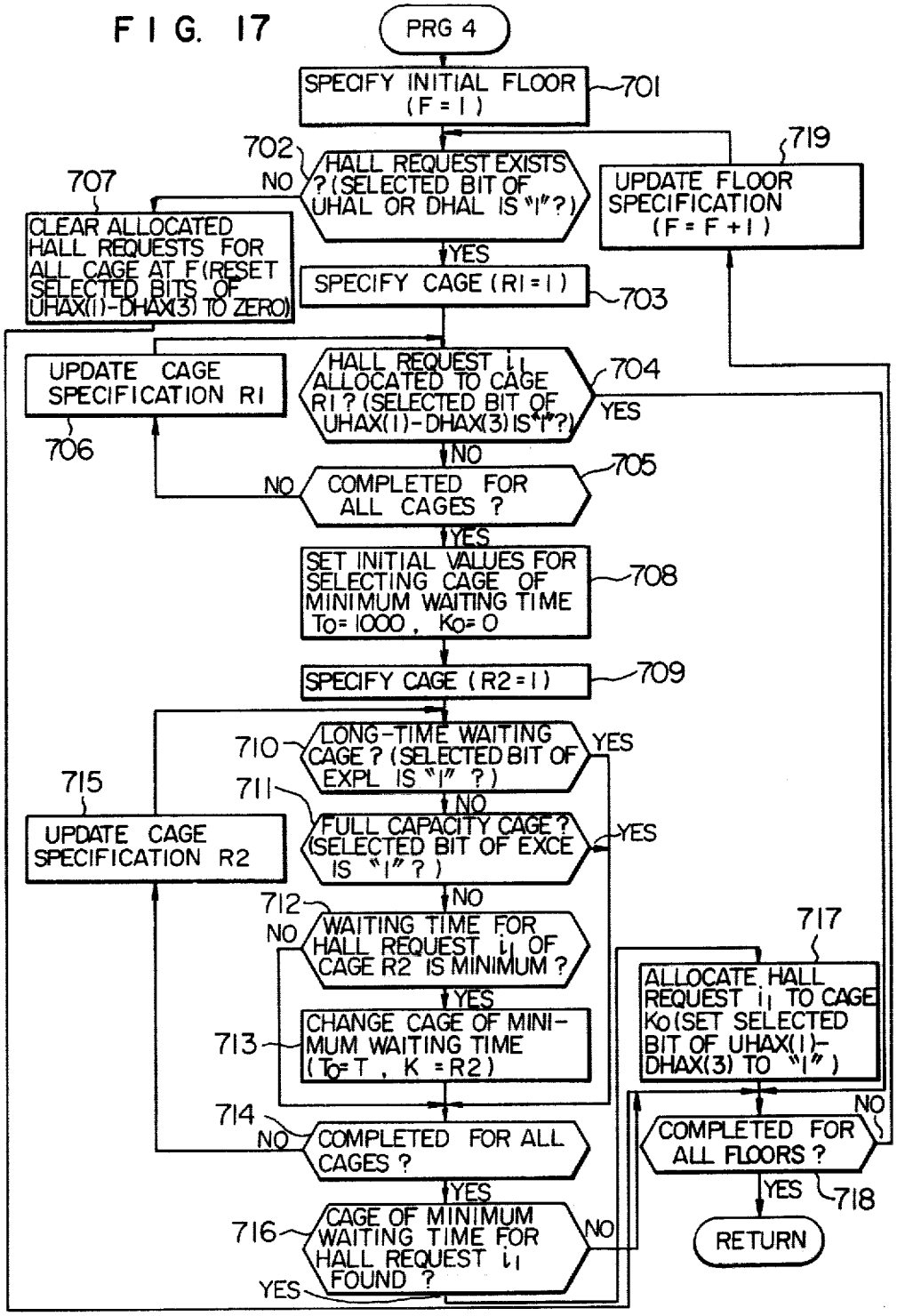
Figure 19:
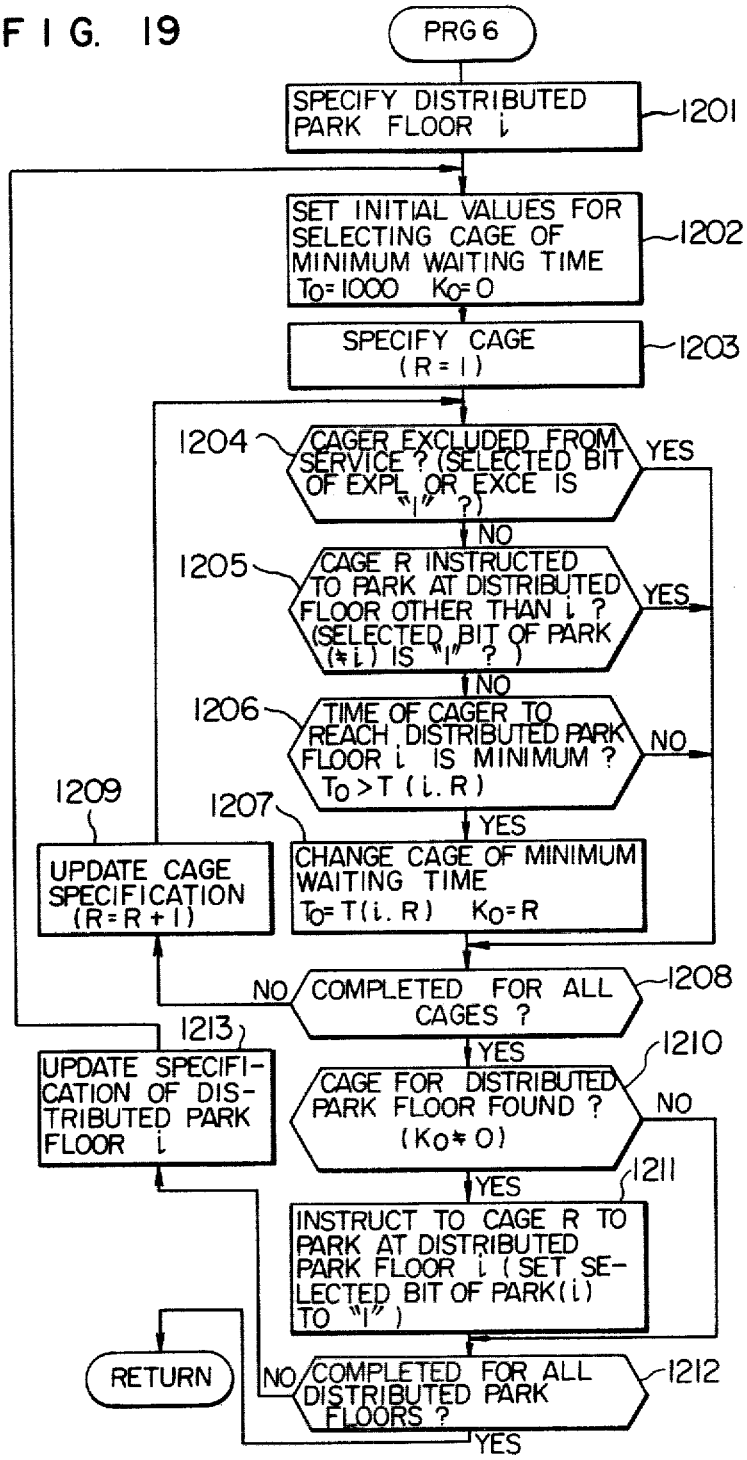
Figure 20:
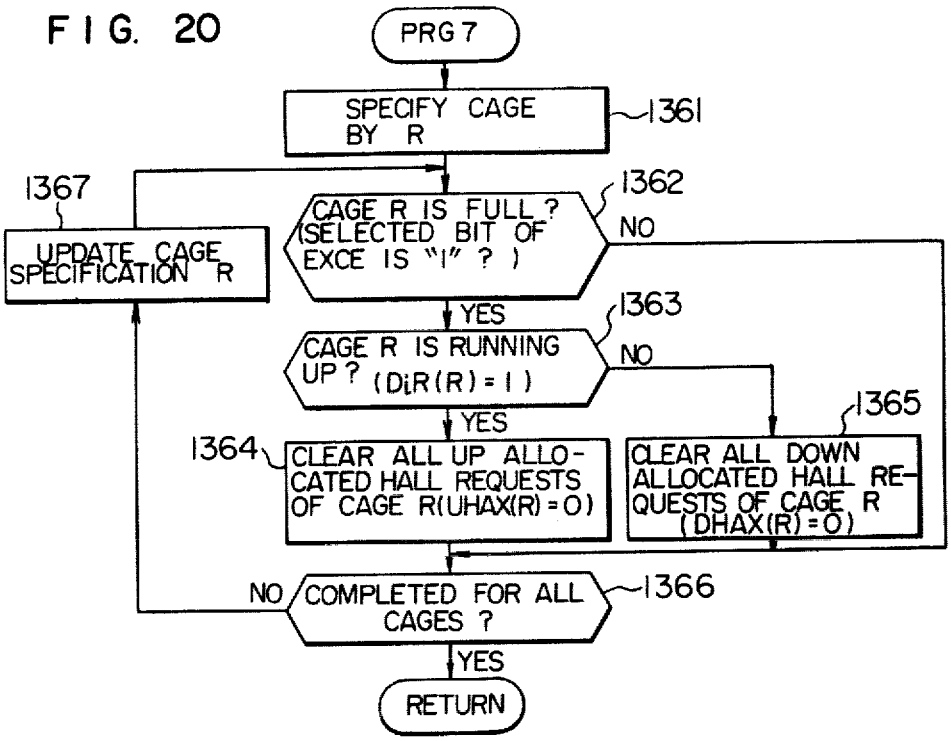
Figure 21:
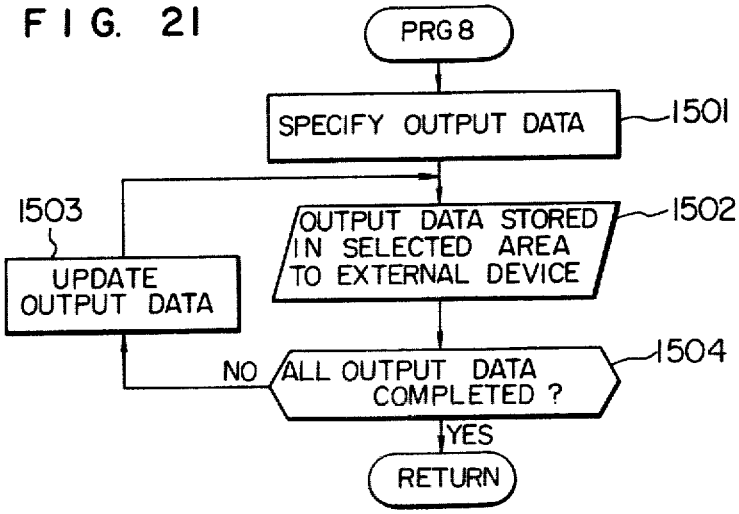
Figure 22:
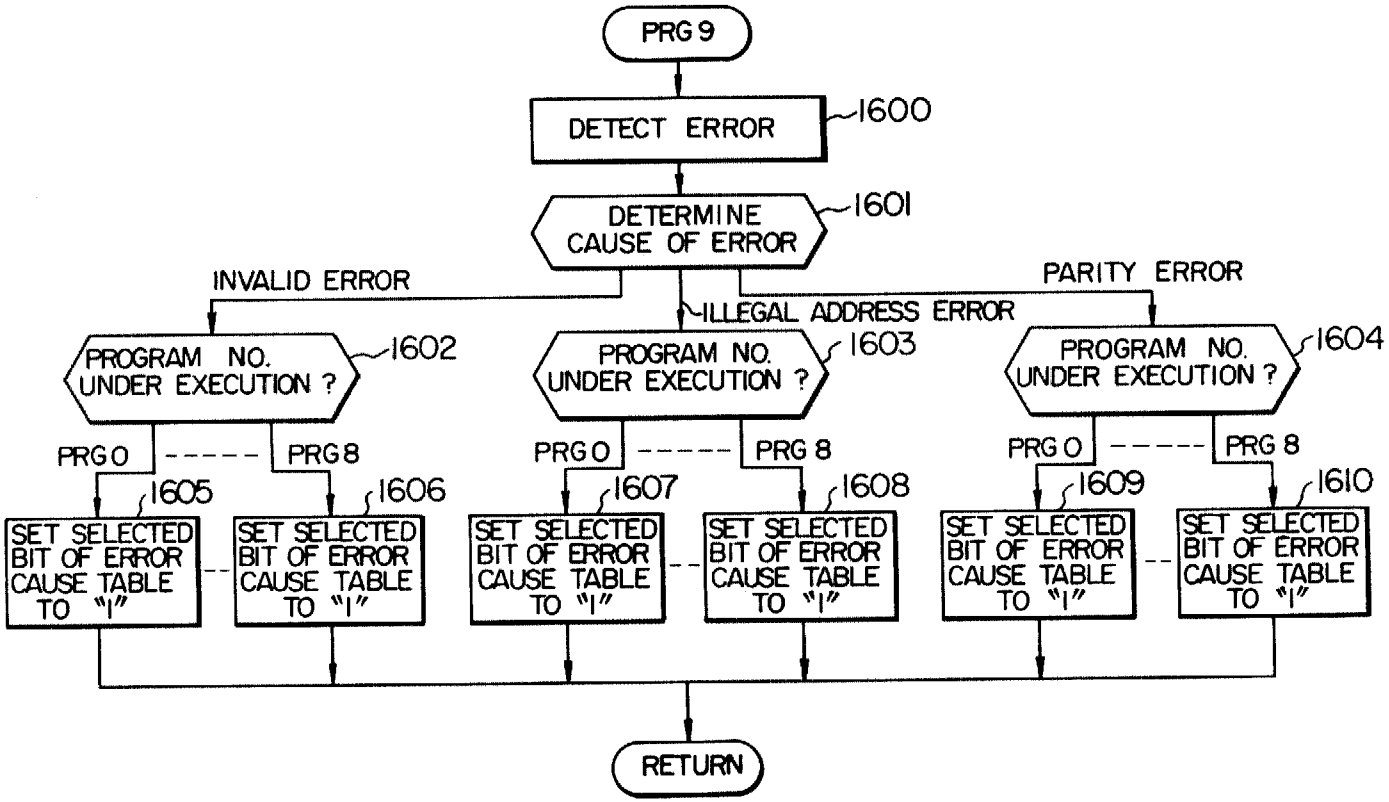

FIGS. 3 to 12 show memory table arrangements in which FIG. 3 shows a table of cage requests, FIG. 4 shows a table of hall requests, FIG. 5 shows a table of directions of elevator run, FIG. 6 shows a table of cage positions, FIG. 7 shows a table of service exception signals, FIG. 8 shows a table of error causes, FIG. 9 shows a table of hall request allocations, FIG. 10 shows a table of hall request allocation exceptions, FIG. 11 shows a table of distributed park instructions and FIG. 12 shows a table of standard distributed park instructions;

FIG. 13 shows an overall flow chart of a group management control program in accordance with one embodiment of the present invention;

FIGS. 14 to 21 show flow charts which show details of the programs in FIG. 13, in which FIG. 14 shows a flow chart of a validity check program, FIG. 15 shows a flow chart of a data entry program, FIG. 16 shows a flow chart of a basic data generation program, FIG. 17 shows a flow chart of a hall request allocation program, FIG. 18 shows a flow chart of a long-time waiting request processing program, FIG. 19 shows a flow chart of a distributed wait instruction program, FIG. 20 shows a flow chart of a request reallocation program for full of capacity, and FIG. 21 shows a flow chart of a data output program; and FIG. 22 shows a flow chart of an error detection program.

Now, referring to the accompanying drawings, a preferred embodiment of the present invention will be explained in detail.

Figure 1:
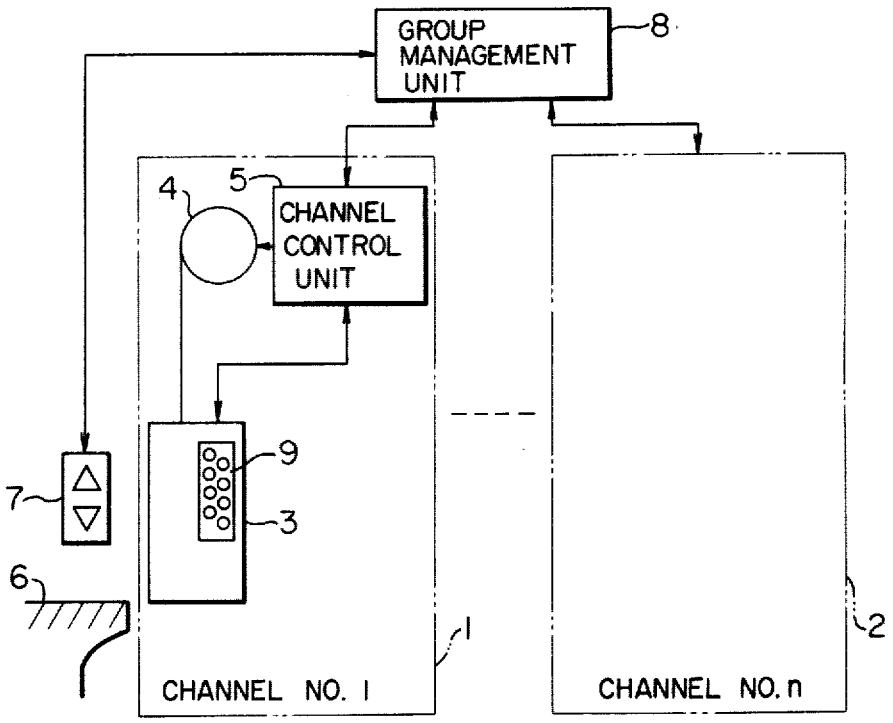
FIG. 1 shows an overall configuration of an elevator control system in accordance with the present invention.

FIG. 1 shows an overall configuration of the elevator control system in accordance with the present invention. The system includes No. 1 channel 1 to No. n channel 2 and each of the channels includes a cage 3, a drive motor 4 for driving the cage and a channel control unit 5 for controlling the entire channel. There are m floors 6 which are provided for elevator service. Each of the floors has up and down hall request buttons 7. The channel control unit 5 and the hall request buttons 7 and under control of a group managment unit 8. The channel control unit 5 controls the motor 4 and the cage 3. The cage 3 has cage request buttons 9.

Figure 2:
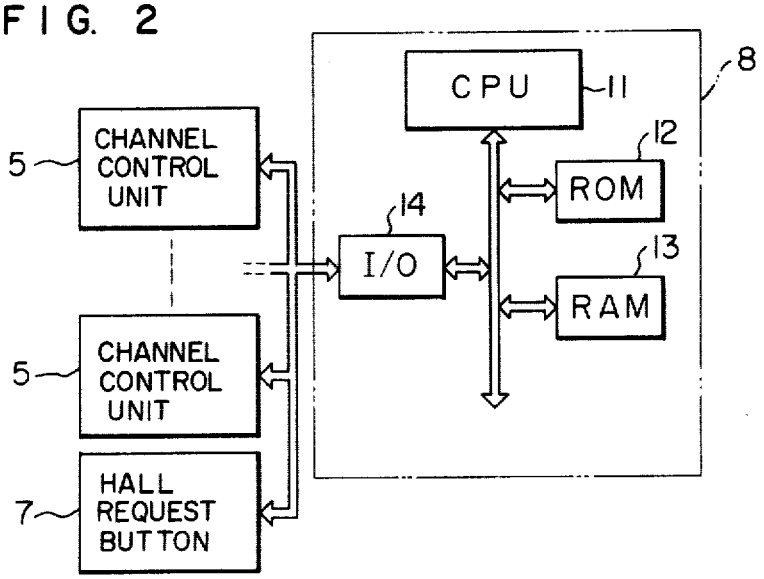
FIG. 2 shows detail of a main portion of FIG. 1.

Referring to FIG. 2, the group management unit 8 comprises a central processing unit (CPU) 11, a ROM 12, a RAM 13 and an I/O unit 14. The I/O unit 14 is coupled to the channel control unit 5 and the hall request buttons 7.

The RAM 13 contains a table in which input and output data and process data are stored. The arrangement of the table is explained with reference to FIGS. 3 to 11. For easier understanding, let us assume that the number of floors of a building is eight and the number of elevator is three.

FIG. 3 shows a table of cage request signals CAG(-1)-CAG(3) of No. 1 to No. 3 elevators, which are issued from the buttons mounted in the cages. Each of the bits corresponds, in ascending order, to the first to eighth floors, respectively.

FIG. 3 shows a table of up and down hall request signals UHAL and DHAL which are issued from the buttons mounted on the respective floors. Each of the bits corresponds, in ascending order, to the first to eighth floors, respectively.

FIG. 5 shows a table of run direction signals DiR(-1)-DiR(3) of the No. 1 to No. 3 elevators, which are issued externally. The o-th bit corresponds to upward run and the first bit corresponds to downward run.

FIG. 6 shows a table of cage position signals POS9-1)-POS(3) of the No. 1 to No. 3 elevators, which are issued externally. Each of the bits corresponds, in ascending order, to the first to eighth floors, respectively.

FIG. 7 shows a table of service exception signals EXCE which function to exclude a full capacity cage from the control of operation. The o-th to second bits correspond to the No. 1 to No. 3 elevators, respectively.

FIG. 8 shows a table which stores error causes ERR(1)-ERR(l) and corresponding programs when errors occured. Each of the bits corresponds, in ascending order, to the programs No. 1 to No. 8.

FIG. 9 shows a table of up and down allocation hall request signals UHAX(1)-DHAX(3) of the No. 1 to No. 3 elevators, which are derived from the computation carried out to attain economic and rational movement of the cages. Each of the bits corresponds, in ascending order, to the first to eighths floors, respectively.

FIG. 10 shows a table of allocation exception signals EXPL which instruct to the cages an express service (while inhibiting allocation to a new hall request) for a long-time waiting request. Each of the bits corresponds, in ascending order, to the No. 1 to No. 3 elevators.

FIG. 11 shows a table of signals which instruct to the cages to park at distributed parking floors. The signals include park signals PARK(1)-PARK(3) for a reference floor, a middle parking floor and an upper parking floor. Each of the bits corresponds, in ascending order, to the No. 1 to No. 3 elevators.

In the above tables, when the signals include "1" bits, they indicate the presence of signals, and when they include "0" bits, they indicate the absence of signals.

FIG. 13 shows a program flow chart for illustrating an overall configuration of a group management control in accordance with the present invention. By way of examples, programs No. 0 to No. 8 corresponding to the respective functions are explained.

(1) Initial Program PRG0 (Step 10)

This program starts upon the power-on and carries out, at a step 10, a system start-up process including clearing or initial setting of various data, initialization of the I/O interface.

(2) Validity Check Program PRG1 (Step 15)

This program PGR1 checks any fault in which the content of a memory which stores data used in the course of exceution of the programs changes by a certain reason.

Referring to FIG. 14, at a step 151, a code for designating a first program is loaded to a register P. At the next step 152, an initial "0" is loaded to a register SUM which stores a sum, and at a step 153 an address corresponding to the program is loaded to an address register ADR. At a step 154, the content of the address regiser ADR is added to the content of the sum register SUM, and at a step 155 the resulting sum is checked if it coincides with the address previously stored in the memory for checking. If the decision is "NO", the content of the address register ADR is incremented at a step 156 and the step 154 is executed again. If the decision at the step 155 is "YES", the sum is compared at, a step 157, with a correct value previously stored in another memory. If the decision is "NO", it is determined that the program has been destroyed by a certain reason and the corresponding bit of the error cause table shown in FIG. 8 is set to "1". Then the process goes to a step 159. If the decision at the step 157 is "YES", it is determined at a step 159 if all of the programs have been checked. If the decision is "NO", the content of the register P is incremented at a step 160 to update the program to the next one and the process goes back to the step 152. If the decision at the step 159 is "YES", the program PRG1 terminates and the step 15 in FIG. 13 terminates.

(3) Data Entry Program PRG2 (Step 30)

This program functions to store the cage request signals CAG(1)-CAG(3) and the hall request signals UHAL and DHAL from the external units to predetermined addresses of the table in the memory. Referring to FIG. 15, at a step 301 a leading address of the predetermined table is set and input data to be stored at that address is specified. At a step 302, the input date designated at the step 301 is applied externally and it is stored at the area specified by the address. At a step 304, it is determined if all of the required data have been stored in the memory, and if they have been stored the process goes back to an exit of the step 30 in FIG. 13, and if not, the address is incremented by one at a step 303 so that the next input data is stored.

(4) Basic Data Generation Program PRG3 (Step 50)

This program functions to calculate, for each of the elevators (cages), a waiting time from a present instant for a hall request by a person who wants to utilize the elevator at each of the floors. Referring to FIG. 16, at a step 500, it is determined if there is a hall request in the table shown in FIG. 4, and if the decision is "NO", the process goes out of the program. If the decision is "YES", at a step 501, a code "1" for the cage No. 1 whose waiting time is to be computed first is set to a register R. At a step 502, a counter S which counts the number of floors to stop before the cage reaches floor which is issuing a hall request and to which no cage has been allocated for stop, and a counter F which counts the number of floors to pass before the cage reaches that floor are reset. At a step 503, a current floor position $i_o$ of the cage stored in the register R is loaded to a register POS. At a step 504, it is determined if the cage has been allocated for stop at the scanning floor specified by the register POS, in response to the hall request. The decision is made by checking if the corresponding bit of the UHAX(1)-DHAX(3) table shown in FIG. 9 is "1" or not. If the decision at the step 504 is "YES", the stop counter S and the floor counter F are incremented by one, respectively, at steps 506 and 507. If the decision at the step 504 to "NO", it is determined at a step 505 if the cage request has been registered so that the cage will be stopped at the scanning floor by checking if the corresponding bit of the CAG(1)-CAG(3) table shown in FIG. 3 is "1" or not. If the decision is "YES", the stop counter S and the floor counter F are incremented by one, respectively, at steps 506 and 507. If the decision at the step 505 is "NO", only the floor counter F is incremented by one. At a step 508, it is determined if the scanning floor number i stored in the register POS coincides with the floor number $i_1$ which issued the hall request and to which the cage has not been allocated for stop. If the decision is "NO", the scanning floor number is incremented by one at a step 509 and the process goes back to the step 504, thence the similar operation is repeated. If the decision at the step 508 is "YES", at a step 510 a time required for the cage specified by the register R to reach from the present position $i_o$ to the floor $i_1$ at which the hall request was issued, that is, a waiting time for the hall request $i_1$ is computed in accordance with the following equation;

$$T=\alpha S+\beta F \quad \ldots (1)$$

where $\alpha$ is a time period required for the cage to stop at a floor, which is approximately ten seconds, and $\beta$is a time period required for the cage to run past a floor, which is approximately two seconds. S and F are counts in the counters S and F, respectively. At a step 511, it is determined if the above process has been completed for all of the cages. If the decision is "NO", the register R is incremented by one at a step 512 and the process goes back to the step 502, thence the above steps are repeated. If the decision at the step 511 is "YES", the process goes out of the step 50 shown in FIG. 13.

(5) Hall Request Allocation Program PRG4 (Step 70)

This program executes an allocation control process in which an optimum cage to serve the hall request is selected and allocated. FIG. 17 shows a detail thereof.

At a step 701, "1" representing the first floor is set to the register F as an initial value. At a step 702, it is determined if a hall request $i_1$ exists in the floor specified by the register F by checking if the corresponding bit of the UHAL and DHAL table shown in FIG. 4 is "1" or not. If the decision is "YES", "1" is set to the register $R_1$ at a step 703 to allocate the first cage, and at a step 704 it is determined if the hall request $i_1$ exists in the cage specified by the register $R_1$ by checking if the corresponding bit of the UHAX(1)–DHAX(3) table shown in FIG. 9 is "1" or not. If the decision is "YES", that cage is to stop in response to the hall request $i_1$ and hence the allocation thereof is not necessary. Accordingly, the process jumps to a step 718. If the decision is "NO", however, it is determined at a step 705 if all of the cages have been checked by the step 704 to determine if the other cage has been allocated for the service to the hall request $i_1$. If the decision is "NO", the register $R_1$ for specifying the cage is incremented at a step 706 and the process goes back to the step 704. If the decision at the step 702 is "NO", the service to the hall request is not necessary for the floor specified by the register F so that the allocation hall requests for all of the cages at that floor are cleared at a step 707. Thus, the corresponding bits of the UHAX(1)–DHAX(3) table shown in FIG. 9 are resets to "0" and the process goes to a step 718.

If the decision at the step 705 is "YES", it indicates than no cage has been allocated to the hall request $i_1$. Accordingly, at a step 708 and the subsequent steps, a cage which is to serve to the hall request is allocated in an efficient and economic manner. At the step 708, "1000" and "0" are loaded to registers $T_o$ and $K_o$, respectively, which are used to select a cage of minimum waiting time. The value 1000 indicates a necessary time $T_o$. Only when a waiting time T of any one of the cages calculated by the program PRG3 is smaller than the time $T_o$, the cage of minimum waiting time is selected. At a step 709, "1" is set to a register $R_2$ to specify the first cage. At a step 710, it is determined if the cage specified by the register $R_2$ is a long-time waiting cage by checking if the corresponding bit of the EXPL shown in FIG. 10 is "1" or not. If the decision is "YES", that cage should be no longer allocated so that the process jumps to a step 714. If the decision at the step 710 is "NO", it is determined at a step 711 if that cage is to be excluded from the service because of full capacity. If the decision is "YES", the process jumps to the step 714, and if the decision is "NO" the process goes to a step 712. At the step 712, it is determined if the waiting time T for the hall request $i_1$ of the cage specified by the register $R_2$ is shorter than the time $T_o$. If the decision is "NO", the process jumps to the step 714, and if the decision is "yes", the time T is stored in the register $T_o$ at a step 713 and the content of the register $R_2$ is shifted to the register $K_o$ to select the cage which is specified by $R_2$ and has the minimum waiting time T. At the step 714, it is determined if the selection of the cage of minimum waiting time has been tried to all of the cages, and if the decision is "NO", the register $R_2$ which specifies the cage is incremented at a step 715 and the process goes back to the step 710. If the decision at the step 714 is "YES", it is determined at a step 716 if a cage of minimum waiting time for the hall request $i_1$ has been found by checking if the content of the register $K_o$ is "0" or not. The register $K_o$ contains information of any cage having a waiting time shorter than the predetermined waiting time corresponding to the value "1000" stored in the register $T_o$ at the step 708. Thus, at a step 717, the cage specified by the register $K_o$ is allocated to the hall request $i_1$. The allocation is carried out by setting "1" to the corresponding bit position of the UHAX(1)–DHAX(3) shown in FIG. 9. At a step 718, it is determined if the above process has been tried to all of the floors, and if the decision is "NO" the register F is incremented by one at a step 719 and the process goes back to the step 702. If the decision at the step 718 is "YES", the step 70 shown in FIG. 13 terminates.

(6) Long-Time Waiting Request Process Program PRG5 (Step 90)

This program instructs to any one of the cages under service to go directly to a floor on which a hall request has not been serviced and has been waiting for a long time, without allocating new hall request to that cage. A detail thereof is shown in FIG. 18.

Referring to FIG. 18, at a step 901, "1" representing the first floor is loaded to the register F as an initial floor data, and at a step 902 it is determined if the hall request $i_1$ exists on the floor specified by the register F. If the decision is "NO", the process jumps to a step 909, and if the decision is "YES" the process goes to a step 903. At the step 903, "1" is loaded to the register R to specify the first cage, and at a step 904 it is determined if that cage is allocated for stop for the hall request $i_1$ of that floor. If the decision is "NO", it is determined at a step 905 if all of the cages have been checked for that floor, and if the decision is "YES" the process goes to a step 909 but if the decision is "NO" the register R is incremented by one at a step 906 to update the cage specification and the process goes back to the step 904.

If the decision at the step 904 is "YES", it is determined at a step 907 if the hall request $i_1$ is a long-time waiting request or not. The decision is made by checking if a sum of the time elapsed so far since the hall request button was pushed and a waiting time T for that hall request is longer than a preset waiting time. If the decision is "NO", the process jumps to a step 909, but if the decision is "YES" the allocation of new hall requests is inhibited to allow that cage to go directly to the floor on which the hall request $i_1$ determined to be the long-time waiting request exists. That is, predetermined bit of EXPL shown in FIG. 10 is set to "1". Then, at a step 909 it is determined if the decision has been made for all of the floors, and if the decision is "NO" the register F is incremented by one at a step 910 to update the floor specification and the process goes back to the step 902. If the decision at the step 909 is "YES", the step 90 shown in FIG. 13 terminates.

(7) Distributed Park Instruction Program PRG6 (Step 120)

This program functions to instruct to the elevators to park at one or more preselected distributed parking floors in an economic manner when no hall request nor cage request exists for any of the cages. A detail of the program is shown in FIG. 19.

At a step 1201, a first distributed parking floor i is specified, and at a step 1202 an initial value is set to select a cage having a minimum time $T_o$ to reach the distributed parking floor i. The setting of the initial value is made by loading "1000" to a time register $T_o$ and "0" to a cage specification register $K_o$. Then, at a step 1203, "1" is loaded to the register R to specify the first cage. At a step 1204, it is determined if the specified cage is a service exception cage, that is, a direct-going cage for the long-time waiting request (i.e. if a predetermined bit of EXPL is "1" or not), or if it is a full-capacity cage (i.e., if a predetermined bit of EXCE is "1" or not). If the decision is "YES", the process jumps to a step 1208, and if the decision is "NO", it is determined at a step 1205 if the specified cage has been instructed to park at a distributed parking floor other than the specified distributed parking floor. If the decision is "YES", the process jumps to the steps 1208, and if the decision is "NO" the process goes to a step 1206. At the step 1206, it is determined if a precalculated time T (i, R) required for that cage to go from the present position to the specified distributed parking floor is shorter than the preset time $T_o$. If the decision is "NO", the process jumps to the step 1208, and if the decision is "YES", that cage is instructed, at a step 1207, to park at the specified distributed parking floor i. The instruction is made by storing the content of the register R to the register $K_o$. The time T (i, R) is stored in the minimum time register $T_o$. If there is another cage which can go to the specified distributed parking floor within a time shorter than the time T (i, R), that cage is specified as a minimum time cage. At the step 1208, it is determined if the check has been made for all of the cages, and if the decision is "NO", the register R is incremented by one at a step 1209 to update the cage specification and the process goes back to the step 1204.

If the decision at the step 1208 is "YES", it is determined at a step 1210 if a cage to park at the specified distributed parking floor i has been found. The decision is made by checking if the content of the register $K_o$ is "0" or not. If the decision is "NO", the process jumps to a step 1212, and if the decision is "YES", a predetermined bit of PARK(1)-PARK(3) shown in FIG. 11 is set to "1" at a step 1211 to instruct to the cage specified by the register R to park at the specified distributed parking floor i. At the step 1212, it is determined if the check has been made for all of the distributed parking floors, and if the decision is "NO", the specification of the distributed parking floor i is updated at a step 1213 and the process goes back to the step 1202. If the decision at the step 1212 is "YES", the step 120 shown in FIG. 13 terminates.

(8) Request Reallocation Program for Full Capacity PRG7 (Step 136)

This program functions to reallocate hall requests already allocated to a cage of full capacity to another cage becaouse the full capacity cage can no longer serve to the subsequent hall requests. A detail thereof is shown in FIG. 20.

Referring to FIG. 20, at a step 1361 a first cage is specified by the register R, and at a step 1362 it is determined if the cage specified by the register R is full capacity. If the decision is "NO", the real-location for the hall requests is not necessary and the process jumps to a step 1366. If the decision at the step 1362 is "YES", it is determined at a step 1363 if the specified cage is running upward. If the decision is "YES", all of the hall requests already allocated to the specified cage and issued from the floors above that cage are cleared at a step 1364. That is, all of the upward bits of the UHAX(R) shown in FIG. 9 are reset to "0". If the decision at the step 1363 is "NO", all of the downward bits of the DHAX(R) issued from the floors below that cage are reset to "0" at a step 1365. At the step 1366, it is determined if the check has been made for all of the cages, and if the decision is "NO", the register R is incremented by one at a step 1367 to update the cage specification and the process goes back to the step 1362. If the decision at the step 1366 is "YES", the step 136 shown in FIG. 13 terminates.

(9) Data Output Program PRG8 (Step 150)

This program allows to output the allocated hall requests UHAX(1)-DHAX(3) and the distributed park instruction signals PARK(1)-PARK(4) to external devices. It also allows to output error cause signals ERR(-1)-ERR(l) to the external devices to display functions in error on lamps. A detail of the program is shown in FIG. 21.

Referring to FIG. 21, at a step 1501, an address of a memory which contains the first data to be outputted is specified, and at a step 1502 the data stored at the memory area specified by the address is outputted to the external device. At a step 1504, it is determined if all of the data have been outputted, and if the decision is "NO", the output data address is updated at a step 1503 and the process goes back to the step 1502. If the decision at the step 1504 is "YES", the step 150 shown in FIG. 13 terminates.

(10) Error Detection Program PRG9

This program sllows to interrupt the process with highest priority when any error occurs during the execution of the programs described above and determine what error has occured in which one of the programs and set an error flag on the error cause table shown in FIG. 8.

When the programs described above are executed in a computer, an instruction data is read out of a memory via a data bus in accordance with an address specified by a program counter, and the instruction data is loaded to an instruction register. The instruction data thus loaded is then decoded by an instruction decoder so that an operation specified by the instruction is executed. At the same time, the program counter is advanced.

In such a process, an invalid error may occur in which an instruction which the instruction decoder cannot decode so that the program cannot be executed, an illegal address error may occur in which an address which does not actually exist is provided during the execution of an instruction so that the data read or write operation is disabled, or a parity error may occur in which the number of "1" bits in the data loaded in the instruction register is not even in an even-parity check system. Those errors can be detected by hardware means, as is commonly known in the art, and various detection means are known.

FIG. 22 shows a program for detecting the error by interrupting the program control with highest priority when the error is detected by the hardware means. Referring to FIG. 22, at a step 1600, if the occurrence of any error is detected, the program PRG9 starts. At a step 1601, a cause of the error is determined. If it is the invalid error, the process goes to a step 1602, if it is the illegal address error, the process goes to a step 1603, and if it is the parity error, the process goes to a step 1604. At the step 1602, 1603 or 1604, it is determined which one of the programs was executed when the corresponding error occurred, and the process goes to step 1605, . . . or 1606, 1607, . . . or 1608; or 1609, . . . or 1610 depending on the program determined, where a predetermined bit of the error cause table shown in FIG. 8 is set to "1", and the process back to the original program.

Referring to FIG. 13, when the computer is powered on, the initial program PRG0 first starts and then the validity check program PRG1, the data entry program PRG2, the basic data generation program PRG3, the hall request allocation program PRG4, the long-time waiting request process program PRG5, the distributed park instruction program PRG6 and the request reallocation program PRG7 for full capacity sequentially starts, and finally the data output program PRG8 starts. Then, the process jumps to the validity check program PRG1 and the above programs are cyclically executed until the computer stops to operate.

Steps 20, 40, 60, 80, 110, 135 and 140 are inserted before the control programs PRG2–PRG8, respectively, to detect errors in the programs PRG2–PRG8.

In the illustrated embodiment, when an error occurs in the data entry program PRG2, the basic data generation program PRG3, the hall request allocation program PRG4 or the data output program PRG8, a predetermined bit of the error cause table ERR(1)–ERR(l) shown in FIG. 8 is set to "1" by the validity check program PRG1 shown in FIG. 14 or the error detection program PRG9 shown in FIG. 22. At the step 20, 40, 60 or 140, therefore, it is determined if the predetermined bits of the corresponding programs in the error cause table shown in FIG. 8 are "1" or not. Since those programs PRG2, PRG3, PRG4 and PRG8 are essential to the control of the operation of the elevators, the operation of the elevators cannot be continued when the error occurs in any one of those programs. Therefore, if the error is detected in the step 20, 40, 60 or 140, the execution of the program is stopped at a step 160 and the occurrence of the error is indicated by a lamp corresponding to the cause of the error.

On the other hand, when an error occurs in the long-time waiting request process program PRG5, the distributed park instruction program PRG6 or the request reallocation program for full capacity PRG7, a predetermined bit of the ERR(1)–ERR(l) in the error table shown in FIG. 8 is set to "1" but the process is not stopped. That is, if the decision at a step 80 is "YES", the process data relating to the program PRG5 is set to a safety side at a step 100. All bits of the EXPL of the allocation exception table shown in FIG. 10 are reset to "0" so that the long-time waiting request process program PRG5 is jumped. If the decision at the step 110 is "YES", the content of the standard distributed park table PARKX(1)–PARKX(3) shown in FIG. 12, which has been previously stored in the ROM, is loaded to the distributed park table PARK(1)–PARK(3) shown in FIG. 11, at a step 130. Consequently, even if an error occurs in the distributed park instruction program PRG6, the elevators park at the standard distributed parking floors. If the decision at the step 135 is "YES", the request reallocation program for full capacity PRG7 is jumped.

In the illustrated embodiment, particularly at the step 130, when an error occurs in the program, the process data related thereto are reestablished so that the distributed park function is maintained although the cage selection function for the distributed park is lost.

As described hereinabove, according to the present invention, it is prevented that the entire function stops by an error occurred in a portion of the system so that the elevator service is continued with a minimum reduction of function.

In the illustrated embodiment, the process is stopped by the error in the hall request allocation program PRG4. Alternatively, by allocating the hall request to all of the cages (that is, setting the allocation bits of all of the cages corresponding to the floors which issues the hall request) to "1" when the hall request is issued), the elevator service can be continued in a manner similar to a conventional signal elevator operation.

While the group management control has been explained in the embodiment, the present invention is also applicable to a single operation control or a two-elevator parallel contorl, in which case the operation can be continued in a similar manner even if an error occurs in the functional portions which are not essential to the operation.

What is claimed is:

1. An elevator control system comprising;

at least one elevator for serving to a plurality of floors, a control unit for controlling said elevator in accordance with a first group of programs and a second group of programs to impart a plurality of functions to said elevator, a fault detection means for detecting a fault occurred in the control operation by said control unit, a first fault processing means for stopping the control by said control means when the fault detected by said first detection means is due to the operation related to a program of said first group, and a second fault processing means for removing the control by a program causing the fault when said program causing the fault is in said second group.

2. An elevator control system according to claim 1 wherein said first group of programs include at least a data entry program for loading cage request signals and hall request signals to predetermined memory areas.

3. An elevator control system according to claim 2 wherein said second group of programs include at least one of a long-time waiting request process program for preferentially serving to a hall request having a service delay longer than a predetermined time period and a request process program for full capacity elevator for inhibiting service to hall requests from the floors ahead of the elevator when said elevator is of full capacity.

4. An elevator control system according to claim 1 wherein said fault detection means includes a fault detection means for at least one of an invalid error, an illegal error, a parity error and a validity check error.

5. An elevator control system according to claim 1 wherein said fault detection means can distinguish a plurality of fault causes and includes a means for loading said fault causes to a memory in a form of tables arranged for each of said first and second program groups.

6. An elevator control system according to claim 1 wherein said first fault processing means includes a means for indicating the occurrence of the fault by a lamp.

7. An elevator control system according to claim 5 wherein said first fault processing means includes a means for indicating the occurrence of the fault by lamps by the fault cause.

8. An elevator control system according to claim 1 wherein said second fault processing means includes a means for setting the process data related to the fault program to a fail-free side.

9. An elevator control system according to claim 1 wherein said second fault processing means has a function to jump the process by the fault program.

10. An elevator control system according to claim 1 wherein a plurality of elevators are included, and said first group of programs include a basic data generation program for calculating waiting times of the elevators to a hall request and a hall request allocation program for selecting an optimum one of the elevators to serve to the hall request.

11. An elevator control system according to claim 1 wherein a plurality of elevators are included, and said first group of programs include a distributed park instruction program for instructing to said elevators to park at predetermined distributed parking floors.

12. An elevator control system according to claim 11 wherein said second fault processing means includes a means for instructing to said elevators to park in a distributed manner in accordance with a predetermined standard distributed parking pattern when a fault occurs in said distributed park instruction program.

* * * * *